US008622855B2

(12) United States Patent
Bednar et al.

(10) Patent No.: US 8,622,855 B2
(45) Date of Patent: Jan. 7, 2014

(54) NOCK DEVICE FOR BOW

(71) Applicants: Richard L. Bednar, Munroe Falls, OH (US); Michael J. Shaffer, Mogadore, OH (US); Jacob A. Hout, Akron, OH (US)

(72) Inventors: Richard L. Bednar, Munroe Falls, OH (US); Michael J. Shaffer, Mogadore, OH (US); Jacob A. Hout, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 13/669,833

(22) Filed: Nov. 6, 2012

(65) Prior Publication Data

US 2013/0116071 A1 May 9, 2013

Related U.S. Application Data

(60) Provisional application No. 61/556,527, filed on Nov. 7, 2011.

(51) Int. Cl.
*F42B 6/06* (2006.01)

(52) U.S. Cl.
USPC ..... 473/578; 473/586

(58) Field of Classification Search
USPC ..... 473/578, 585, 586
See application file for complete search history.

(56) References Cited

U.S. PATENT DOCUMENTS

| | | | | |
|---|---|---|---|---|
| 4,544,163 | A * | 10/1985 | Scanlon | 473/578 |
| 5,154,432 | A * | 10/1992 | Saunders | 473/578 |
| 5,186,470 | A * | 2/1993 | Easton et al. | 473/578 |
| 6,203,457 | B1 * | 3/2001 | Snook | 473/586 |

* cited by examiner

*Primary Examiner* — John Ricci
(74) *Attorney, Agent, or Firm* — Emerson Thomson Bennett, LLC

(57) ABSTRACT

One or more techniques and/or systems are disclosed for a nock device that may be used on an arrow. A top portion a nock device can comprise one or more pairs of string guide impression on its top surface, where the respective one or more pairs of string guide impressions may be symmetrically arranged on the top surface, with respect to each other. A first pair of string guide impression can be disposed along a first bisecting line on the top surface, and, if present, a second pair of string guide impressions can be disposed along a second bisecting line on the top surface. The respective one or more pairs of string guide impression can be configured to receive a bowstring, where the first pair may receive the bowstring in a first orientation, and the second pair, if present, may receive the bowstring in a second orientation.

16 Claims, 15 Drawing Sheets

NOCK DEVICE FOR BOW

CROSS-REFERENCE TO RELATED APPLICATIONS

This application claims the benefit of U.S. Provisional Application No. 61/556,527, filed Nov. 7, 2011. All of the subject matter disclosed by U.S. Provisional Application No. 61/556,527 is hereby incorporated by reference into this application.

BACKGROUND

In the sport of archery it is well known to provide a so-called nock at the rear end of the arrow, which, in essence is a slot, or other means, to engage the bowstring of a bow during the draw. It is also well known that in order to perform a good aim and subsequent shot of the arrow the nock should be placed on the bow string at a point close to the center of the bowstring and that said point should also be aligned horizontally with a point at which the arrow is supported at the center of the bow. In order to attain such alignment, it is known to provide a so-called center nock attached to the center of the bowstring, which may engage the rear end of the arrow, while it is being driven by the bowstring toward the target.

Current nocks in the marketplace may include flat, half-moon or slotted nocks that are not versatile, in that, they may need to be placed in a specific orientation, namely, in a specific orientation with respect to an arrow's vanes or fletching. As an example, aligning the arrow according to the vanes in a wrong position may not allow the nock to effectively engage the bowstring. That is, for example, a groove in the nock may not lie along the bowstring properly. Also, flat nocks (e.g., those without noticeable grooves and/or slots) may allow the user to engage the arrow with the bowstring in any desired alignment; however, they do not properly align the vanes in an effective position each time the arrow is drawn. Thus, a nock that can provide effective alignment of the arrow on the bowstring, while providing versatility of the flat nock may be desirable.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

There is provided an archery-based system wherein a nock can comprise more than one position for engaging the bowstring. Such a nock may take advantage of a flat nock's versatility, for example, and/or effective alignment provided by a notched nock. Such a nock may be oriented in alignment with any suitable arrangement of the arrow's fletching, for example, and may provide a way to center the arrow in contact with the bowstring.

In one implementation of an arrow nock device, the nock device can comprise a top portion that comprises a top surface. Further, the top portion can comprise at least a first string guide impression and a second string guide impression. In this implementation, respective string guide impressions can be symmetrically disposed on the top surface, with respect to each other. Additionally, the first string guide impression may be disposed at a first location on the top surface, and the second string guide impression can be disposed at a second location on the top surface. The first and second locations maybe disposed at opposite ends of a bisecting line or the top surface. The first string guide impression can also be configured to receive a first part of a bowstring, and the second string guide impression can be configured to receive a second part of the bowstring.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1:
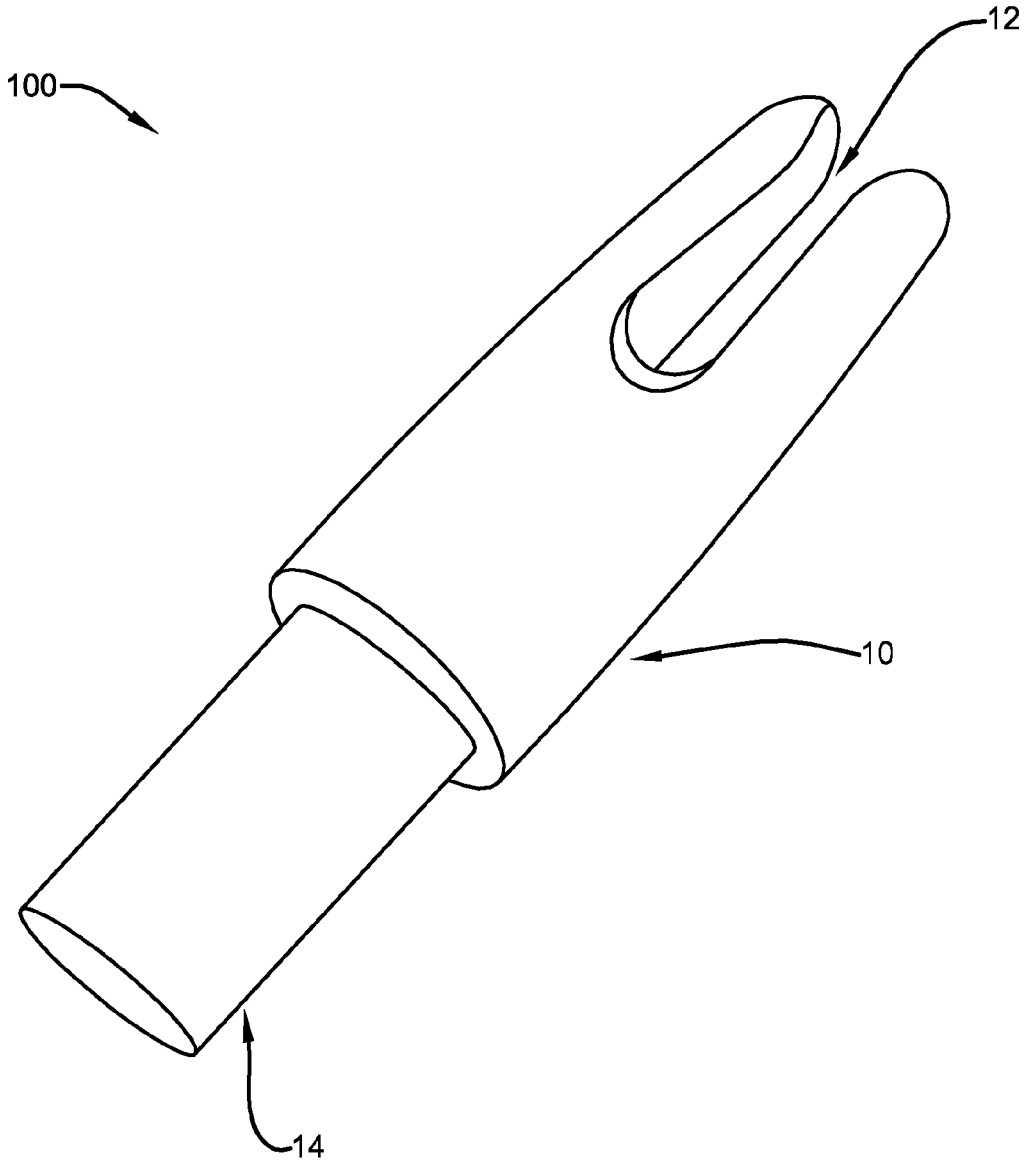
FIG. 1 is a component diagram illustrating a perspective view of an example implementation of a nock.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

FIG. 1 is a component diagram illustrating a perspective view of an example implementation 100 of a nock. In this implementation 100, the nock 10 comprises a slotted portion 12 and a shaft engagement portion 14. As one example, a bowstring of a bow (e.g., long bow, compound bow, recurve bow, crossbow, etc.) may engage the slotted portion 12 of the nock 10, where the bowstring may suitably fit into the opening of the slotted portion 12. Further, in this example, the shaft engagement portion 14 may be configured to suitably fit into an end (e.g., a rear, or opposite end from the point of the arrow) of an arrow shaft (not shown). Typically, the shaft engagement portion 14 can be held in place in the end of the arrow shaft by a pressure fit, such that the shaft end is configured to snugly fit the shaft engagement portion 14. Further, in one implementation, the shaft engagement portion 14 may fitted in the end of the arrow shaft and held in place by an application of glue.

In this implementation 100, the slotted portion 12 of the nock 10 may merely allow for two orientations of the arrow against the bowstring. That is, for example, in a first orientation (e.g., top of arrow up) the fletching vanes of the arrow may be aligned in a first position, and in a second orientation (e.g., top of arrow down) the fletching vanes of the arrow may be aligned in a second position.

Figure 4A:
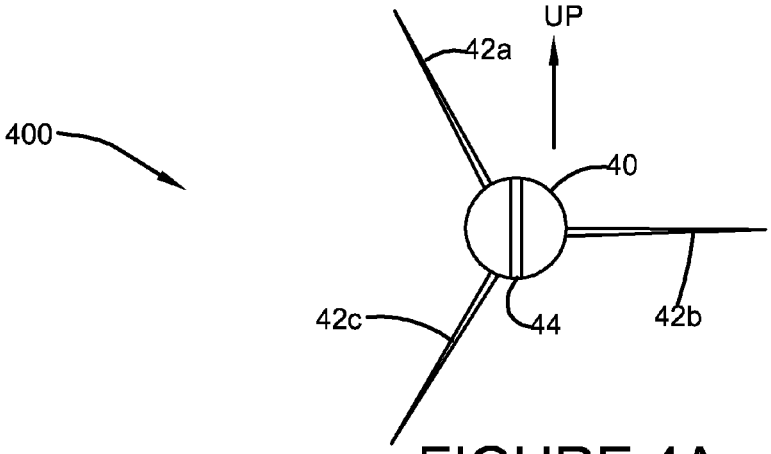
FIGS. 4A, 4B and 4C are component diagrams illustrating a rear view of example implementations where one or more systems described herein may be implemented.
Figure 4B:
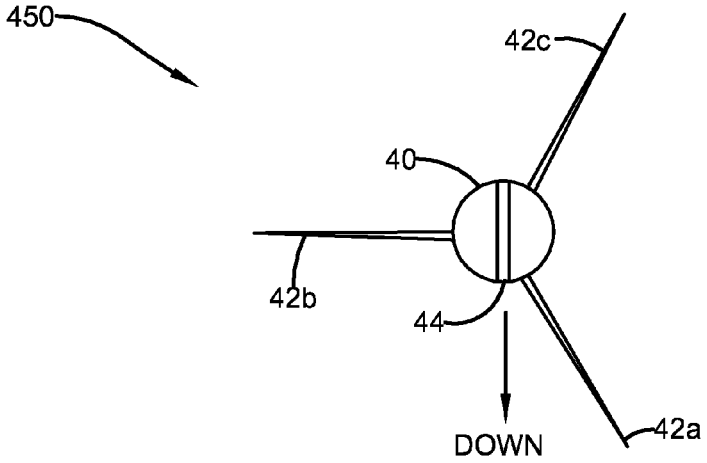

As an illustrative example, FIGS. 4A and 4B are component diagrams illustrating a rear perspective view of example implementations 400, 450 of a portion of an arrow. In the example implementation 400, an arrow shaft 40 comprises an alignment groove/slot 44 (e.g., comprised on the nock), which is oriented in an up position. In this position, the fletching vanes 42 attached to the arrow shaft 40 can be aligned in the first position, for example, where vane 42*b* protrudes to the right at approximately ninety degrees from the orientation of the groove 44, and vanes 42*a* and 42*c* protrude to the left at approximately thirty degrees and one-hundred and fifty degrees, respectively, from the orientation of the groove 44 (e.g., respective vanes aligned approximately one-hundred and twenty degrees apart).

Figure 4C:
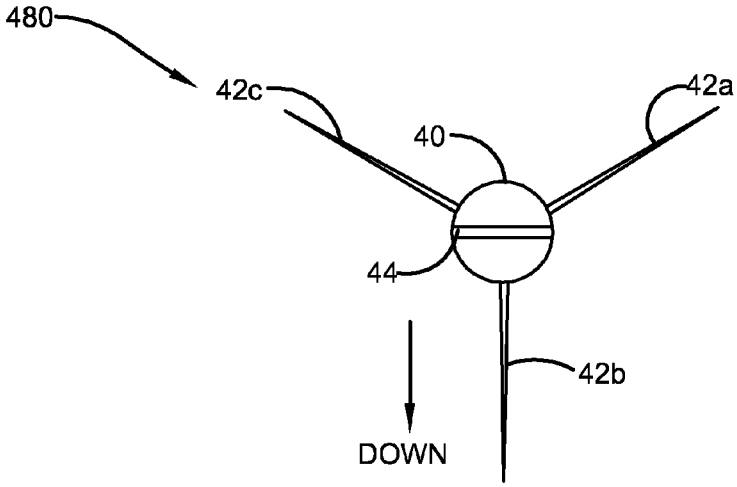
Figure 5A:
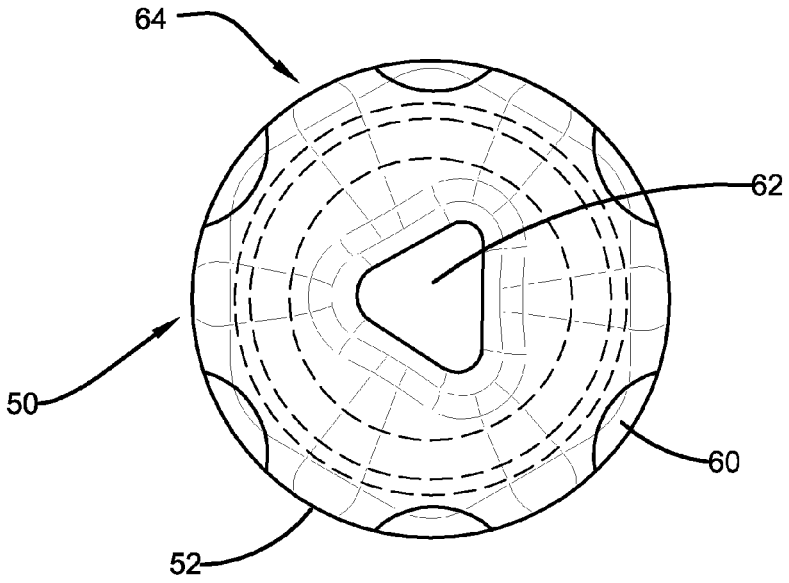
FIG. 5A is a component diagram illustrating a top view of an example implementation of a nock device.
Figure 5B:
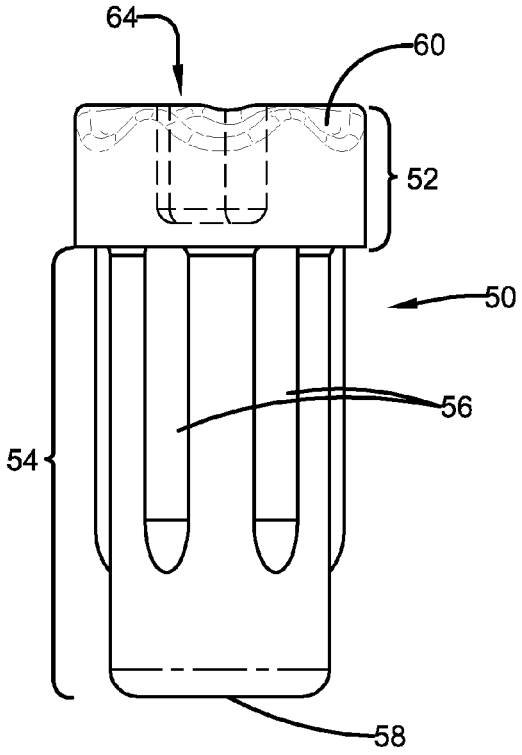
FIG. 5B is a component diagram illustrating a side view of an example implementation of a nock device.
Figure 5C:
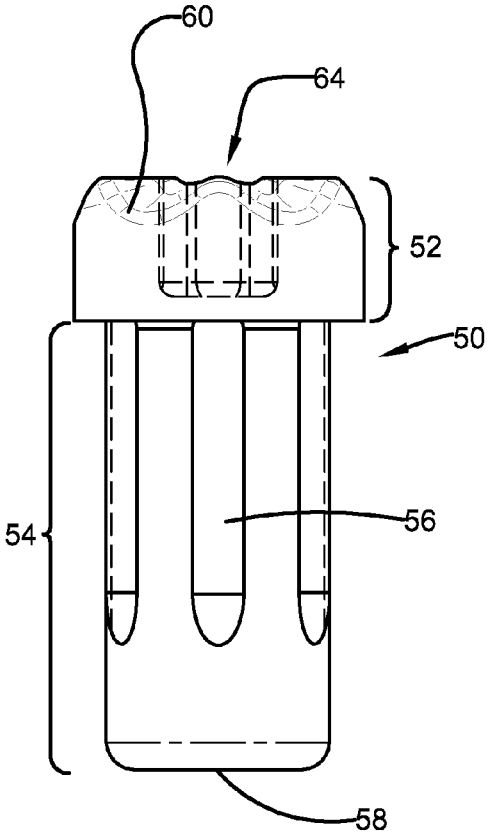
FIG. 5C is a component diagram illustrating a side view of an example implementation of a nock device.

In the example implementation 450, the arrow shaft 40 may be rotated one-hundred and eighty degree (e.g., flipped over), where the alignment groove 44 is oriented in a down position. In this implementation 450, the respective alignment of the vanes 42 has changed to a second position, placing them in an opposite position relative to the up orientation of the example implementation 400. In this way, for example, the dual orientation of the slotted nock may accommodate both right-handed and left-handed vertical bow shooters. The slotted nock can accommodate merely one appropriate position on a crossbow barrel, as illustrated in FIG. 4C, where, in the example implementation 480, the vane 42*b* may be disposed in a barrel slot of the crossbow (e.g., proper operational position). In this example implementation 480, placing either vane 42*a* or 42*b* in the downward position (e.g., in the barrel slot) may not allow for proper alignment of the groove 44 with a crossbow bowstring. The slotted nock is merely limited to these two orientations, for example, where merely one orientation (e.g., 400) may be used in a crossbow.

Figure 2:
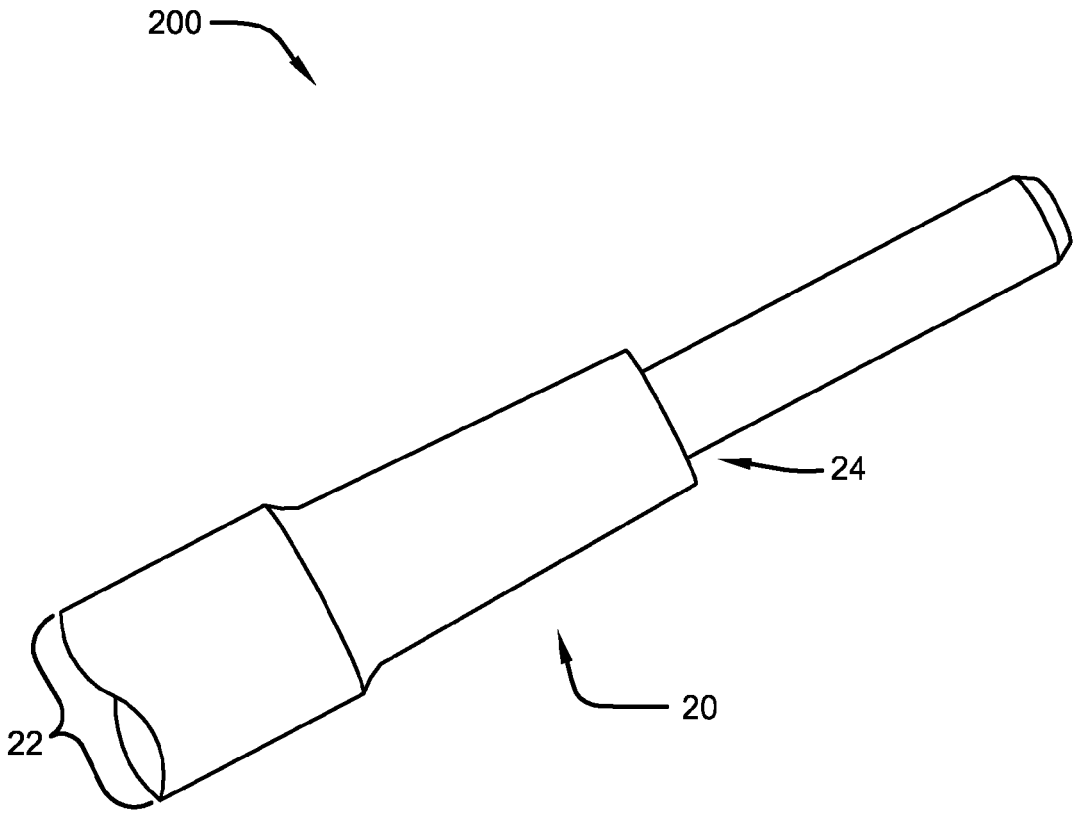
FIG. 2 is a component diagram illustrating a perspective view of an example implementation of a nock.

FIG. 2 is a component diagram illustrating a perspective view of an example implementation 200 of a nock. The example implementation 200 comprises a half-moon style nock 20. The nock 20 comprises a grooved portion 22 and a shaft engagement portion 24. As one example, a bowstring of a bow may engage the grooved portion 22 of the nock 20, where the groove of the grooved portion 22 can accommodate a bowstring, for example, and align the bowstring at the center of the groove. Further, in this example, the shaft engagement portion 24 may be configured to suitably fit into an end of an arrow shaft (not shown). The shaft engagement portion 24 may be pressure fit into the end of the arrow shaft, such that the shaft end is configured to snugly fit the shaft engagement portion 24.

Figure 10A:
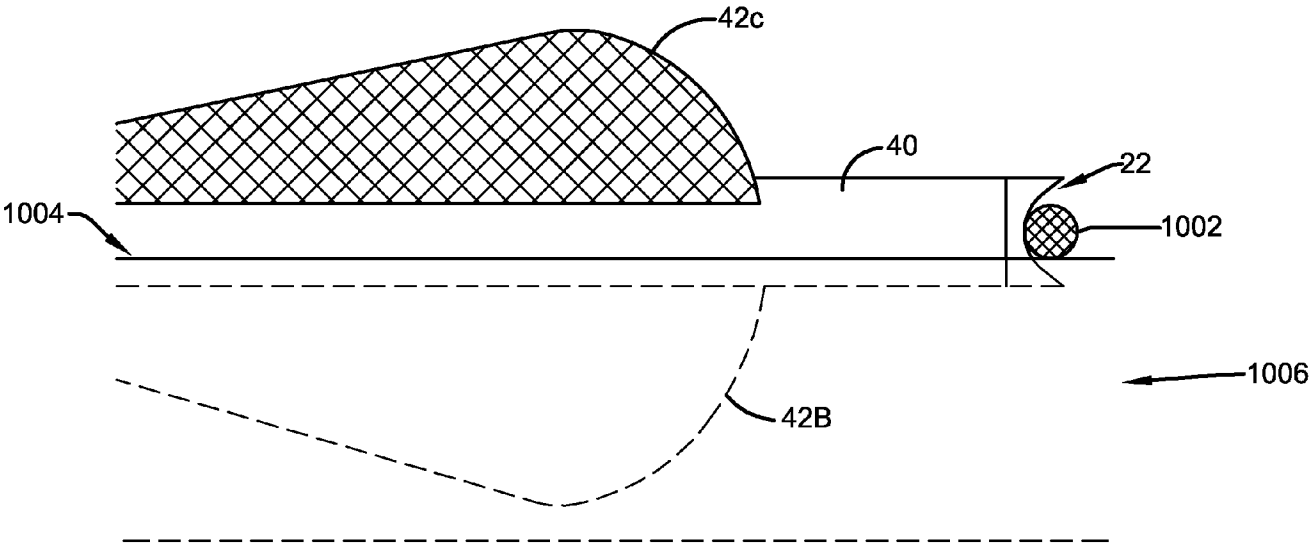
FIGS. 10A and 10B are component diagrams illustrating example implementations where a nock may be utilized.
Figure 10B:
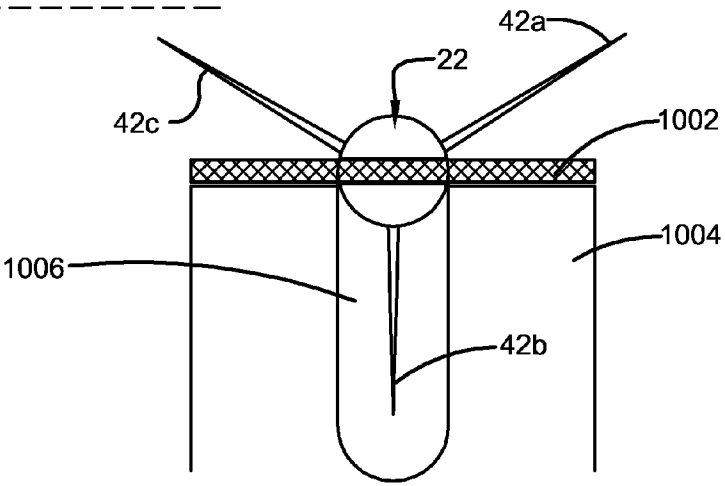

Like the slotted nock 10 of FIG. 1, the half-moon nock 20 may merely allow for two orientations of the arrow against the bowstring. That is, for example, as illustrated in FIGS. 4A and 4B, a groove 44 at the back end of the arrow shaft 40 (e.g., comprising a half-moon nock) may merely allow the arrow to orient in an up position, as in the example implementation 400, or a down position, as in example implementation 450. Much like the slotted nock 10 of FIG. 10, for example, the half-moon nock allows the arrow fletching vanes to be oriented to accommodate both a right-handed and a left-handed handed bow shooter, and/or accommodate an appropriate position on a crossbow barrel, but does not allow for alternate orientations.

Figure 3:
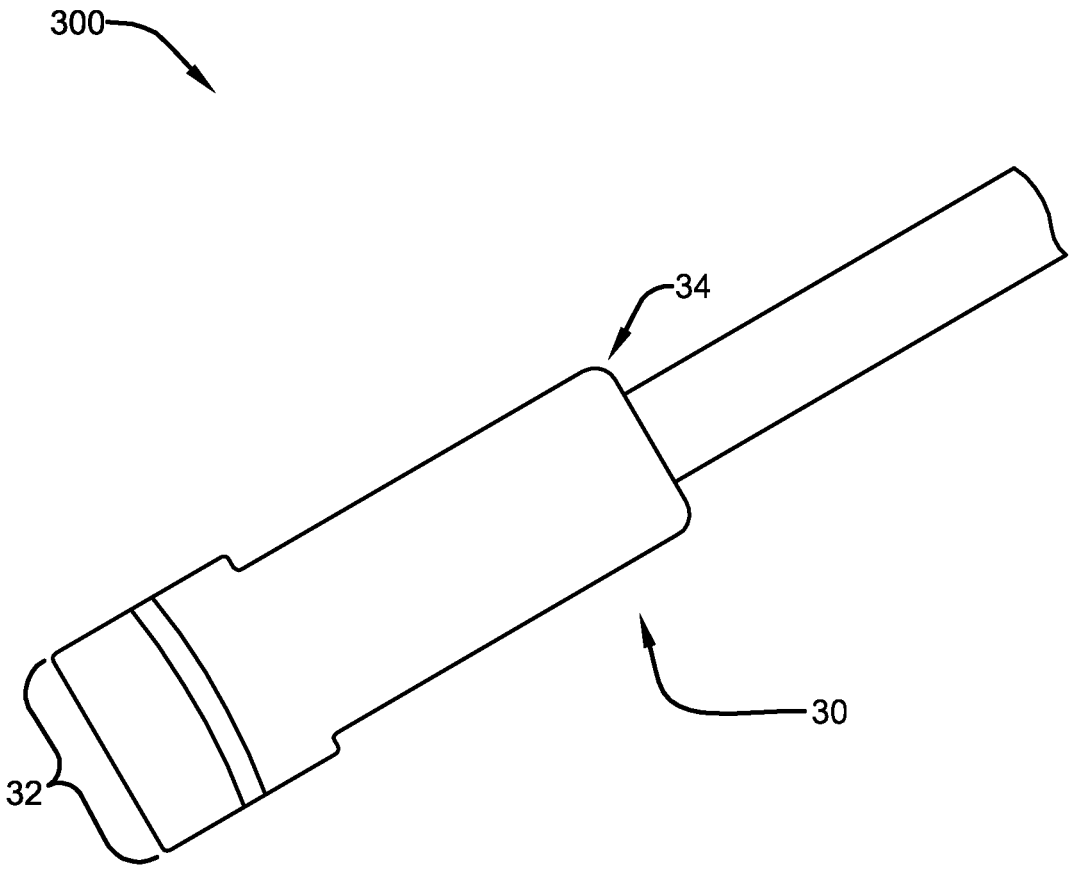
FIG. 3 is a component diagram illustrating a perspective view of an example implementation of a nock.

FIG. 3 is a component diagram illustrating a perspective view of an example implementation 300 of a nock. In the example implementation 300, a flat nock 30 does not comprise an obvious slot or groove, but merely comprises a flat portion 32 and a shaft engagement portion 34. In this implementation, for example, a user may engage the bowstring to the flat portion 32 of the flat nock 30 at any suitable location on the flat portion 32. Further, in this example, the shaft engagement portion 34 may be configured to suitably fit into an end of an arrow shaft (not shown).

As one example, unlike the slotted nock 10 of FIG. 1 and/or the half-moon nock 20 of FIG. 2, a flat nock 30 may allow various orientations of the arrow against the bowstring, merely dependent upon how the user decides to align the nock 30 on the bowstring. However, the configuration of the flat portion 32 of the flat nock 10 may not provide for a way of appropriately centering the bowstring on the flat portion 32, as is found with the slotted nock 10 of FIG. 1 and the half-moon nock 20 of FIG. 2. That is, for example, while the orientation of the flat nock 30 is not limited by a slot or groove, thereby allowing various alignments of the arrow's fletching vanes, the center alignment of the bowstring on the nock cannot be assured.

FIGS. 5-9 illustrate one of more example implementations of an alternate nock device 50. As illustrated in the example embodiments of FIGS. 5A, 5*b*, and 5C, the nock device 50 comprises a top portion 52. The top portion 52 comprises two or more string guide impressions 60, where the respective string guide impressions 60 are symmetrically disposed on a top surface 64 of the top portion 52.

As illustrated in the example embodiments of FIGS. 6A, 6B, 6C, and 6D, a first string guide impression 60*a* is configured to receive a first part of a bowstring, and a second string guide impression 60*b* is configured to receive a second part of the bowstring. Further, the first string guide impression 60*a* is disposed at a first location on the top surface 64, and the second string guide impression 60*b* is disposed at a second location on the top surface 64. In this implementation, the first location and the second location are disposed at opposite ends of a first bisecting line 70*a* of the top surface 64.

Figure 6A:
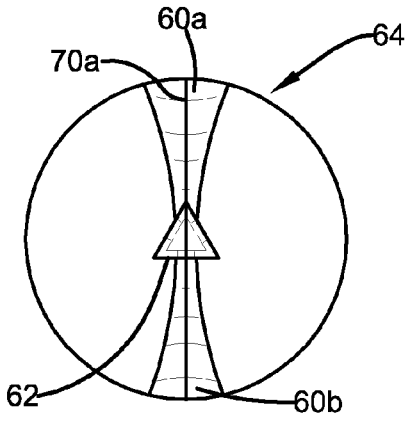
FIGS. 6A, 6B, 6C, and 6D are component diagrams illustrating a rear view of example implementations of one or more systems described herein.
Figure 6B:
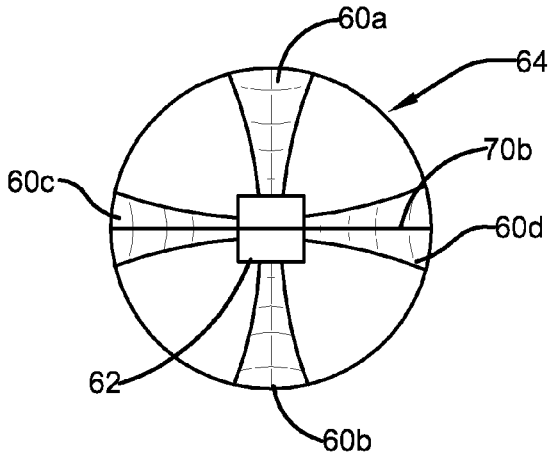
Figure 6C:
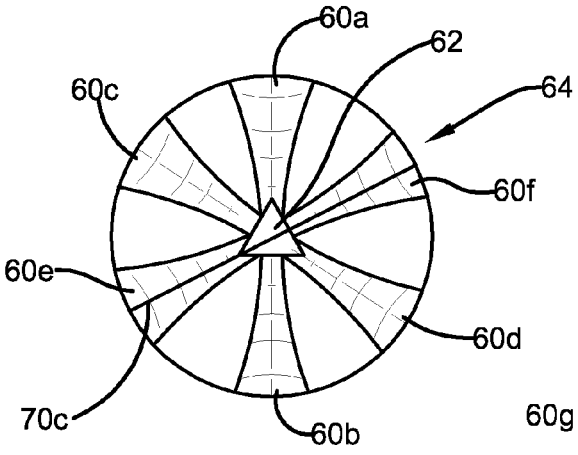
Figure 6D:
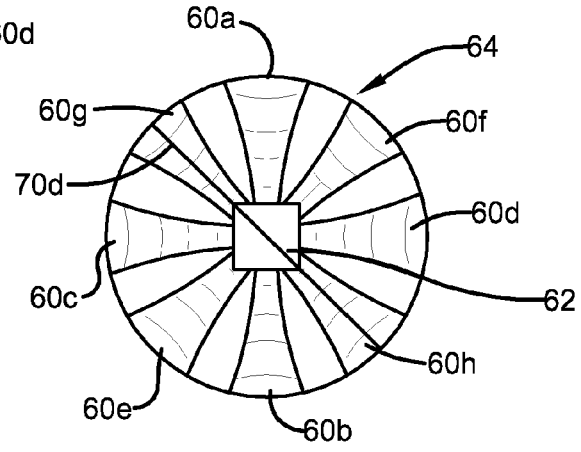

In one implementation, as illustrated in FIGS. 6B, 6C, and 6D, a third string guide impression 60*c* can be configured to receive the first part of the bowstring, and a fourth string guide impression 60*d* can be configured to receive the second part of the bowstring. Further, the third string guide impression 60*c* may be disposed at a third location on the top surface 64, and the fourth string guide impression 60*d* may be disposed at a fourth location on the top surface 64. In this implementation, the third location and the second location can be disposed at opposite ends of a second bisecting line 70*b* of the top surface 64.

In one implementation, as illustrated in FIGS. 6C, and 6D, a fifth string guide impression 60*e* can be configured to receive the first part of the bowstring, and a sixth string guide impression 60*f* can be configured to receive the second part of the bowstring. Further, the fifth string guide impression 60*e* may be disposed at a fifth location on the top surface 64, and the sixth string guide impression 60*f* may be disposed at a sixth location on the top surface 64. In this implementation, the fifth location and the sixth location can be disposed at opposite ends of a third bisecting line 70*c* of the top surface 64.

In another implementation, a seventh 60*g* and eighth 60*h* string guide impression can receive the first and second part of the bowstring, respectively, where the seventh 60*g* and eighth 60*h* string guide impressions are disposed at a seventh and eighth location, respectively, on the top surface 64, at opposite ends of a fourth bisecting line 70*d*. It will be understood that the systems, described herein, are not limited to the example implementations described above. It is anticipated that those skilled in the art may devise alternate arrangements for the string guide impressions.

For example, while implementations of up to four pairs of string guide impressions have been described above, utilizing symmetrical spacings of approximately one-hundred and eighty degrees, ninety degrees, sixty degrees, and forty-five degrees apart, other orientations are anticipated to be within the scope of the described systems. As one example, the top portion 52 may comprise five or more pairs of string guide impressions arranged in an orientation to accommodate a particular arrangement of fletching vanes and/or shooting arrangements (e.g., left-handed, right handed, crossbow, longbow, etc.).

Figure 7A:
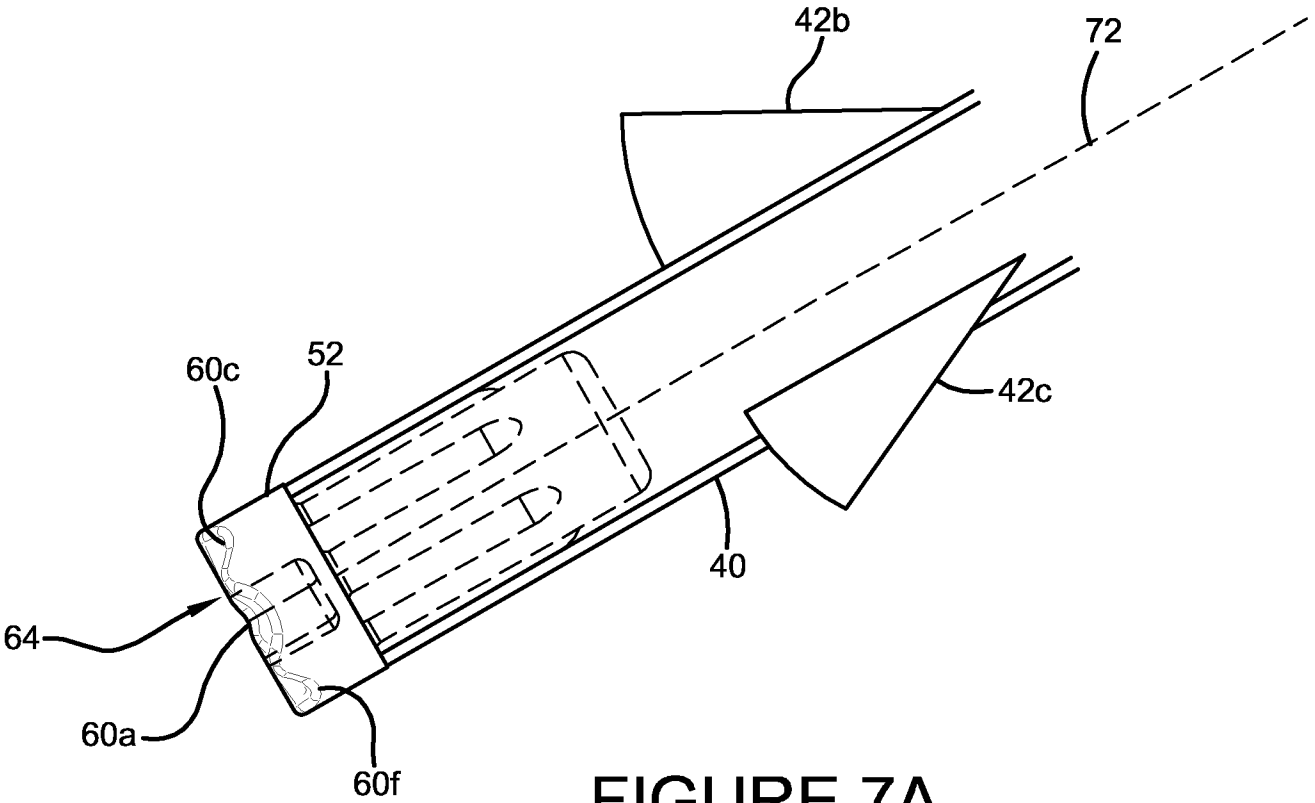
FIG. 7A is a component diagram illustrating a perspective view of an example implementation of a nock device for use in one or more systems described here.

In one implementation, the string guide impressions may be arranged in accordance with an arrangement of the fletching vanes of the arrow, for example, configured to accommodate the number and arrangement of vanes on the arrow (e.g., two, three, four, or more). That is, for example, when the nock device is attached to the arrow, a center line of a string guide impression 60 may be offset from a center line (measured along the length of the arrow) of one or the fletching vanes 42. As an illustrative example, FIG. 7A illustrates an example implementation of an arrangement of a portion of an arrow. In this implementation, an alignment of the fletching vane 42*c* can be offset from the center line 72 of the string guide impression 60*a* (e.g., by thirty degrees). Further, in this implementation, the alignment of the fletching vane 42*b* may be offset (e.g., by ninety degrees) from the center line 72 of the string guide impression 60*a* (e.g., and by thirty degrees from the center line or string guide impression 60*c*).

Figure 7B:
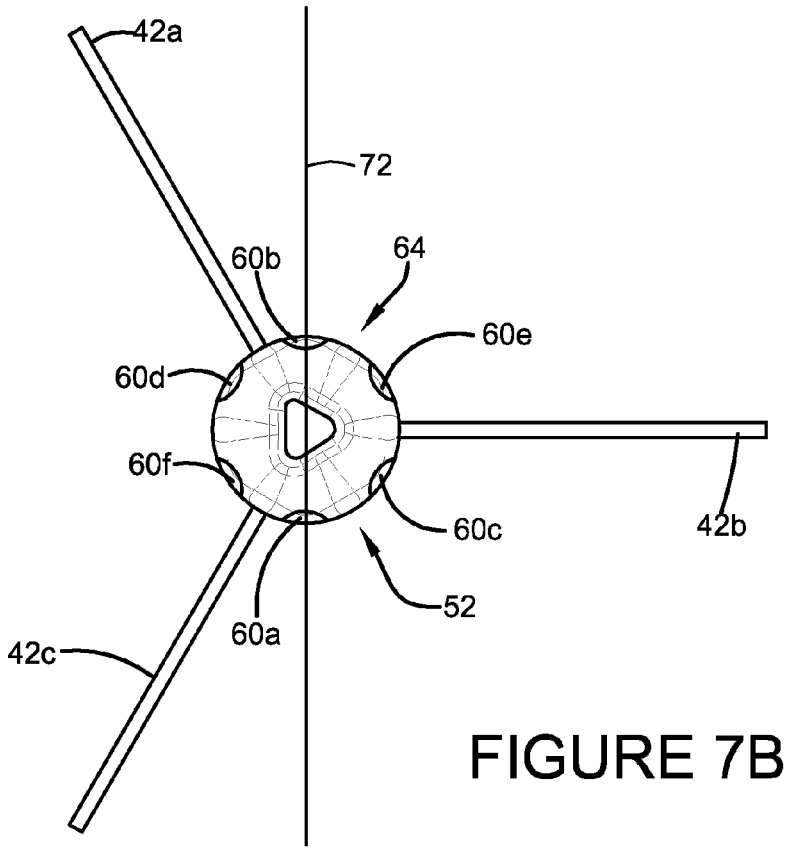
FIGS. 7B and 7C are component diagrams illustrating a rear view of an example implementation of a nock device for use in one or more systems described here.

As another illustrative example, in FIG. 7B, when using an arrow comprises merely three fletching vanes 42*a*, 42*b*, 42*c*, the nock device implemented can comprise three pairs of symmetrically aligned string guide impressions 60*a*-60*f* (e.g., FIG. 6C). In this example implementation, an arrangement of the impressions 60*a*-60*f* can be configured to mitigate interference of the fletching vanes 42*a*-42*c* with the structure of the bow, and/or accommodate the barrel of a crossbow. In order to mitigate interference of the vanes with the bow structure and/or accommodate a crossbow, the impressions 60 may be aligned when the nock device is inserted into the arrow shaft in an orientation (e.g., in FIGS. 4A and 4B) that allows the vane(s) to pass over the riser (e.g., for a bow), and/or to be inserted into a barrel (e.g., for a crossbow), appropriately.

Figure 7C:
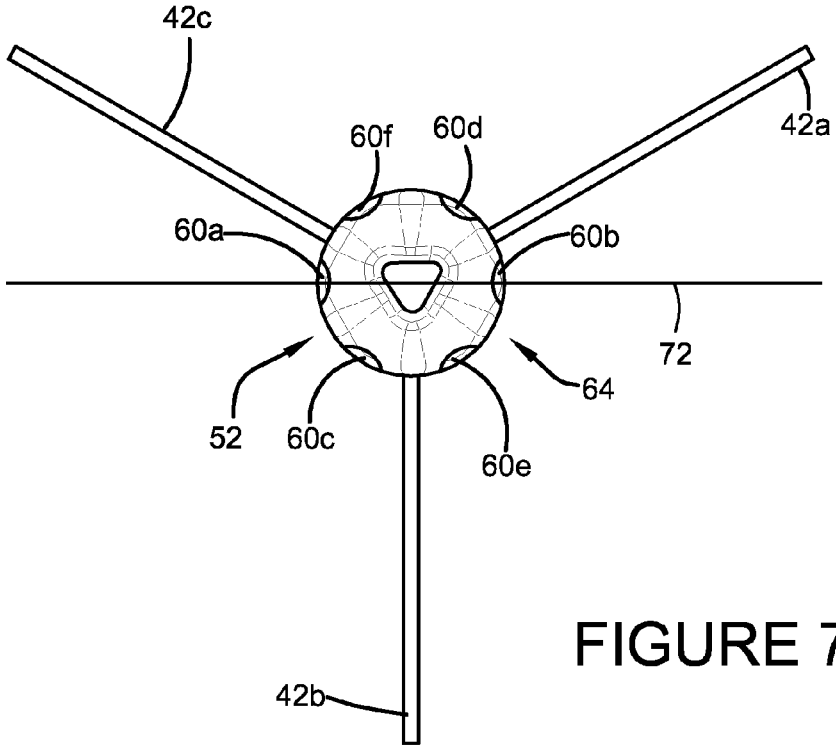
Figure 8A:
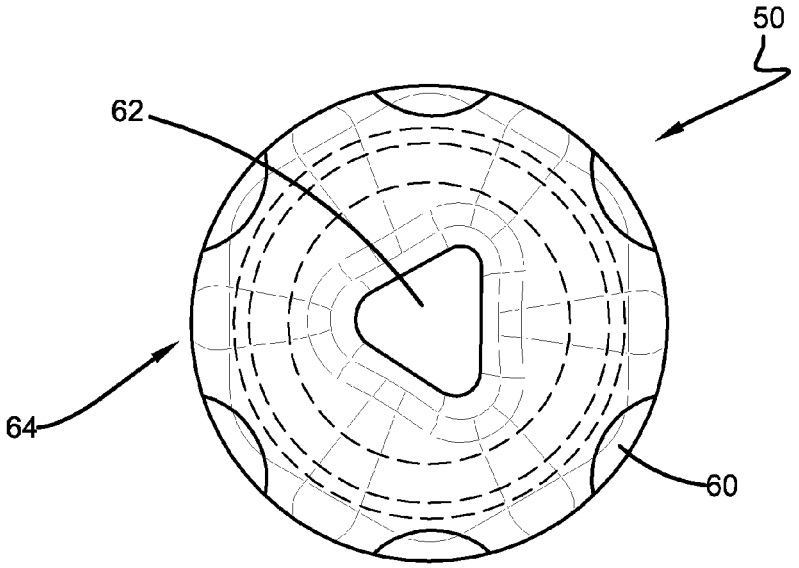
FIG. 8A is a component diagram illustrating a top solid view of an example implementation of a nock device.
Figure 8B:
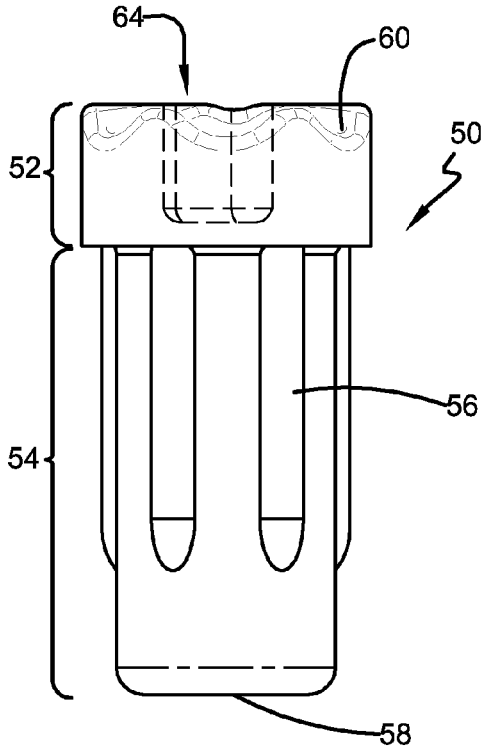
FIG. 8B is a component diagram illustrating a front solid view of an example implementation of a nock device.
Figure 8C:
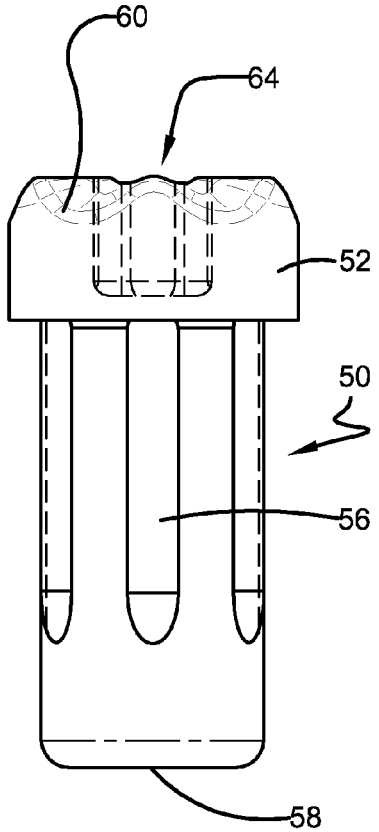
FIG. 8C is a component diagram illustrating a side solid view of an example implementation of a nock device.

In the example implementation of FIG. 7B, the center line 72 of the string guide impression 60*a* and 60*b* may comprise a centrally bisecting line on the top surface 64 of the top portion 52 of the nock device. Further, as one example, a user of the nock device may aligned the bowstring (e.g., of a bow and/or crossbow) along the center line 72 of the string guide impression 60*a* and 60*b*. In this example, a vertical bow, bowstring aligned in such a manner (e.g., for a left-handed archer) may allow the fletching vanes 42*a* and 42*c* to appropriately clear a vertical riser of the bow when the bowstring is released (e.g., thereby shooting the arrow). Further, as illustrated in FIG. 7C, a crossbow, bowstring aligned along the center line 72 in such a manner may allow the fletching vane 42*b* to be appropriately engaged (e.g., inserted down into) a barrel slot of the barrel of the crossbow; thereby allowing the arrow to be appropriately shot from the crossbow.

As another example, an arrow comprising three vanes (e.g., 42*a*, 42*b*, 42*c*), disposed one-hundred and twenty degrees apart from each other around the arrow shaft, may allow for three nocking positions (e.g., comprising six string guide impressions) on a bowstring of a bow and/or on the crossbow barrel. Further, for example, an arrow comprising two vanes, disposed one-hundred and eighty degrees apart, may utilize a nock device comprising four string guide impressions (e.g., FIG. 6B) at ninety degree (e.g., allowing for two nocking positions, one for a bow the other for a crossbow). Additionally, as an example, an arrow comprising four vanes may utilize a nock device comprising eight string guide impressions (e.g., FIG. 6D), disposed at forty-five degrees apart (e.g., allowing for four nocking positions, two for a bow, two for a crossbow); and so on.

Returning to FIGS. 5-9, in one implementation, as illustrated in the example embodiments of FIGS. 5B, 5C, 8B and 8C, the nock device 50 can comprise a stem portion 54, which may comprise one or more outward protrusions 56 and/or a chamfered base 58. As an example, the stem portion 54 may be configured to be inserted into a rear opening of an arrow shaft. Further, for example, the chamfered base 58 of the stem portion 54 may be configured to facilitate insertion into the rear opening of an arrow shaft, where the rounded edges can mitigate snagging of the stem portion 54 on an edge of the rear opening of an arrow shaft. Additionally, as an example the outward protrusions 56 may facilitate securing the nock device 50 within the shaft of the arrow. That is, for example, the outward protrusions 56 can increase the diameter of the nock device 50 with respect to the diameter of the shaft, which may help form a pressure friction fit within the shaft of the arrow.

In one implementation, in a center portion of the nock device top portion 52, an attachment slot 62 may be disposed, where the attachment slot 62 can extend through at least a portion of the top portion 52. In one implementation, the attachment slot 62 may be formed into a triangular shape. In other implementations, the attachment slot 62 may be formed to any appropriate shape for aligning an attachment, such as a square and/or other polygon.

Figure 9:
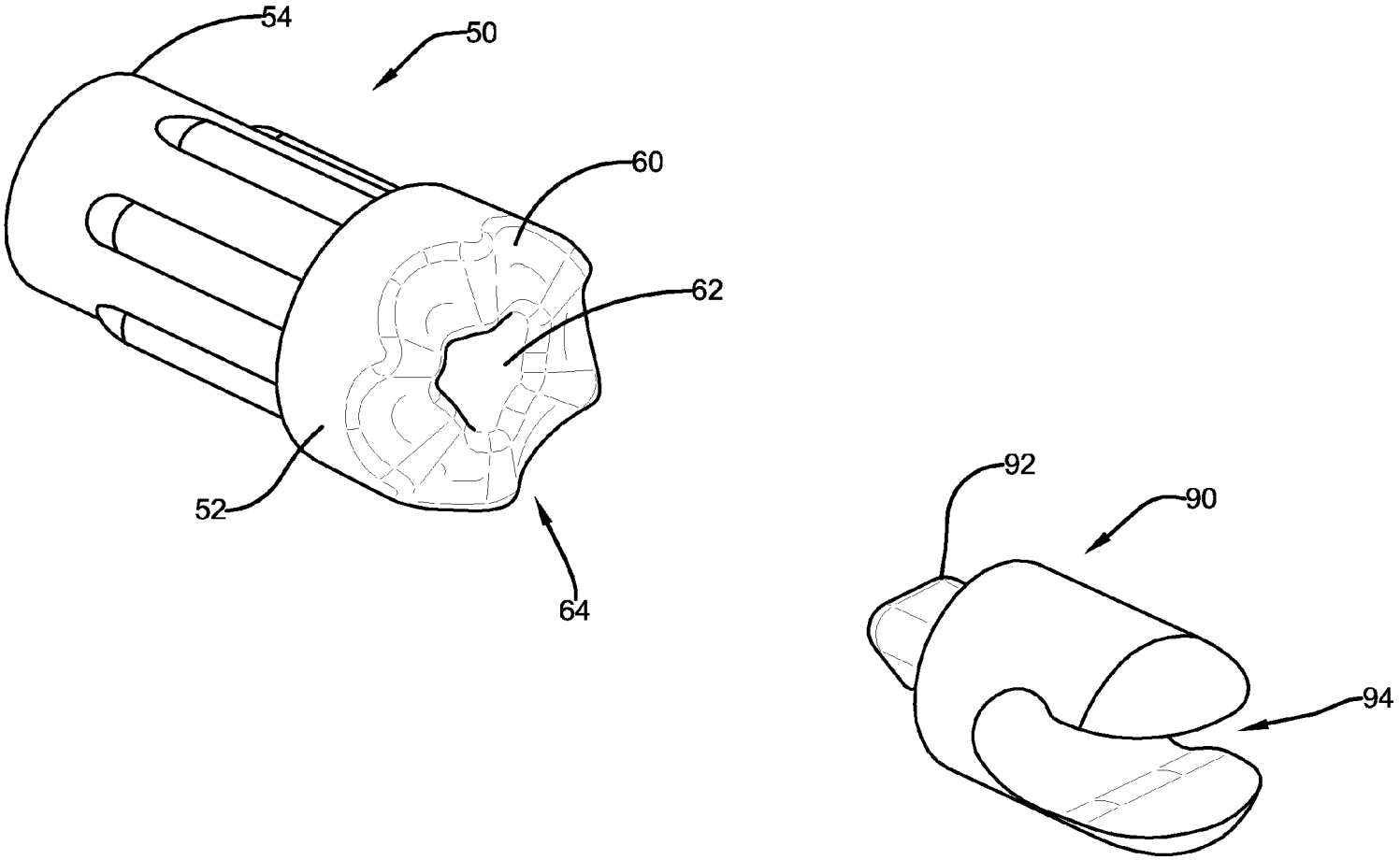
FIG. 9 is a component diagram illustrating a perspective view of an example implementation of one or more portions of the systems described herein.

FIG. 9 is a component diagram illustrating an example implementation of the nock device. In one implementation, the nock device 50 can comprise a nock guide 90. The nock guide 90 may be configured to be selectively removable from the nock device 50, such as from the attachment slot 62. The nock guide 90 may be further configured to facilitate appropriate alignment of the nock device 50, for example, when assembled to an arrow. In one implementation, the nock guide 90 can comprise a male portion 92 that is configured to selectively mate with the attachment slot 62. As one example, a shape of the male portion 92 may comprise a complimentary shape of an attachment slot 62 to which it is intended to be mated (e.g., both the male portion and slot are triangular, or square, etc.).

In one implementation, the nock guide 90 can be attached to the nock device 50, and the bowstring of the bow (e.g., longbow, crossbow, etc.) may be inserted into a nock guide slot 94 of the nock guide 90. As one example, an arrow shaft may be attached to the stem portion 54 of the nock device 50 while the user aligns the fletching vanes in accordance with the desired use (e.g., right-handed, left-handed, longbow, crossbow, etc.) In this way, for example, the arrow, the nock guide 90, and nock device 50 can be in appropriate alignment with the fletching vanes of the arrow, such as for use with crossbows in aligning the vanes within the slotted portion of the barrel.

As an illustrative example, in an operation of a bow, the bowstring is cocked and the arrow, with the nock against the bowstring, is drawn back with the bowstring. In accordance with one implementation of the nock device 50 comprising the three pairs of string guide impressions, the arrow can be aligned any one of three arrangements in accordance with the vanes of the arrow, the handedness of the shooter, and/or the arrangement of the bow riser/handle. As another example, in operation of a crossbow, the bowstring is cocked into a ready-to-shoot position by the user. Subsequently, the arrow can be loaded on the barrel, with at least one of the vanes inserted into a slotted portion of the barrel, with the nock device 50 pressed against the bowstring. In this example, the arrow may be aligned in any one of three positions, in accordance with the vanes of the arrow and the slotted portion of the barrel.

Now with reference to FIGS. 10-13, and continued reference to FIGS. 5-9, in one aspect, when a traditional nock, such as a half-moon nock, is misaligned with the bowstring 1002, for example, such that a centerline of the groove portion 22 of the nock is not aligned with (e.g., parallel to) the bowstring 1002, the arrow 40 may not shoot from the bow (e.g., crossbow) in a desired manner. That is, for example, a user of a bow (e.g., crossbow, vertical bow) may occasionally misalign a traditional nock with the bowstring 1002. A misalignment of this type can result in undesirable flight characteristics for the arrow 40 when the bowstring 1002 is released, for example, causing the arrow 40 to miss an intended target.

As one example, the groove portion 22 of a half-moon nock (e.g., and other traditional nocks) is configured to align parallel to, and engage with, the bowstring 1002. Due to this alignment, as described above, merely one configuration of the fletching vanes 42 of an arrow 40 may be utilized. For example, when a crossbow is used, a first fletching vane 42*b* is disposed in the barrel slot 1006 of the barrel 1004 of the crossbow, such that the groove portion 22 of the nock is appropriately aligned with the bowstring 1002. Further, two second vanes 42*a*, 42*c* are disposed above (e.g., and not in contact with) the barrel 1004. In this way, for example, when the bowstring is released from a shooting position (e.g., the crossbow is shot), the arrow may travel properly down the barrel, and may further travel a desired flight path (e.g., to the intended target).

Figure 11A:
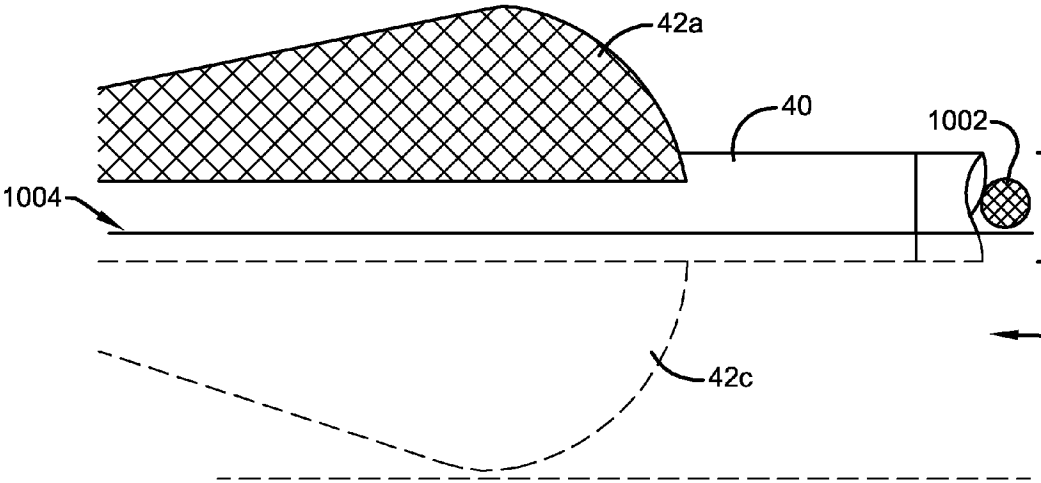
FIGS. 11A, 11B and 11C are component diagrams illustrating example implementations where a nock may be utilized.
Figure 11C:
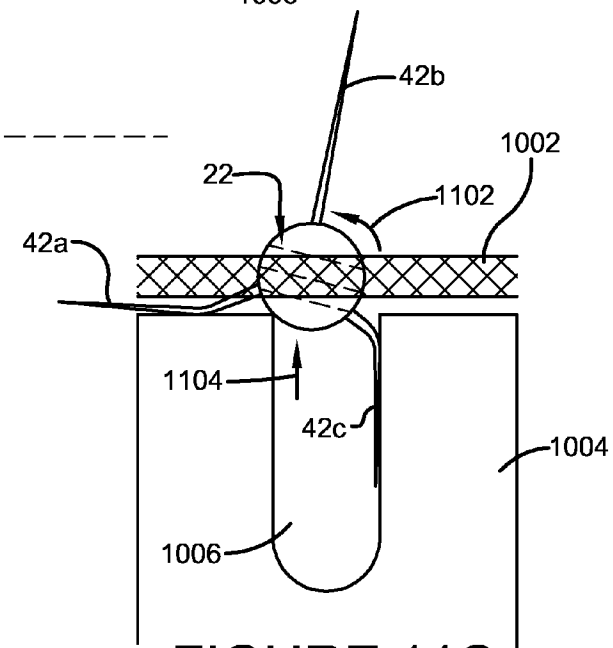
Figure 11B:
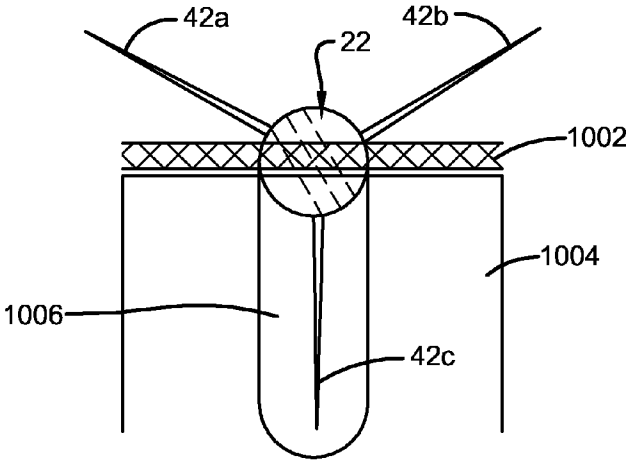
Figure 12A:
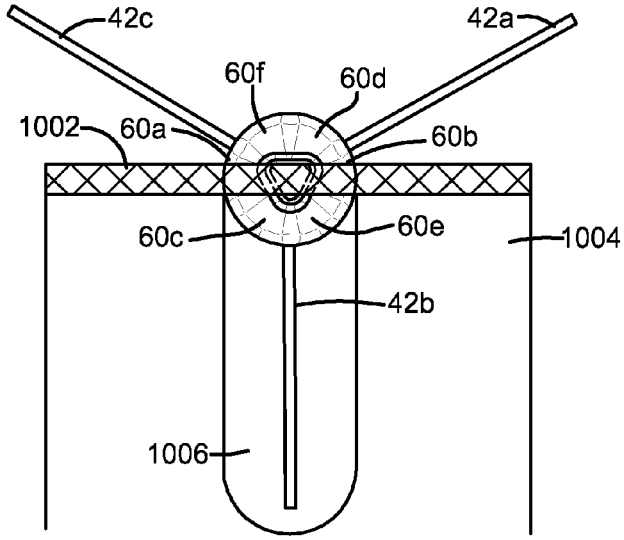
FIGS. 12A and 12B are component diagrams illustrating example implementations where one or more systems described herein may be implemented.
Figure 12B:
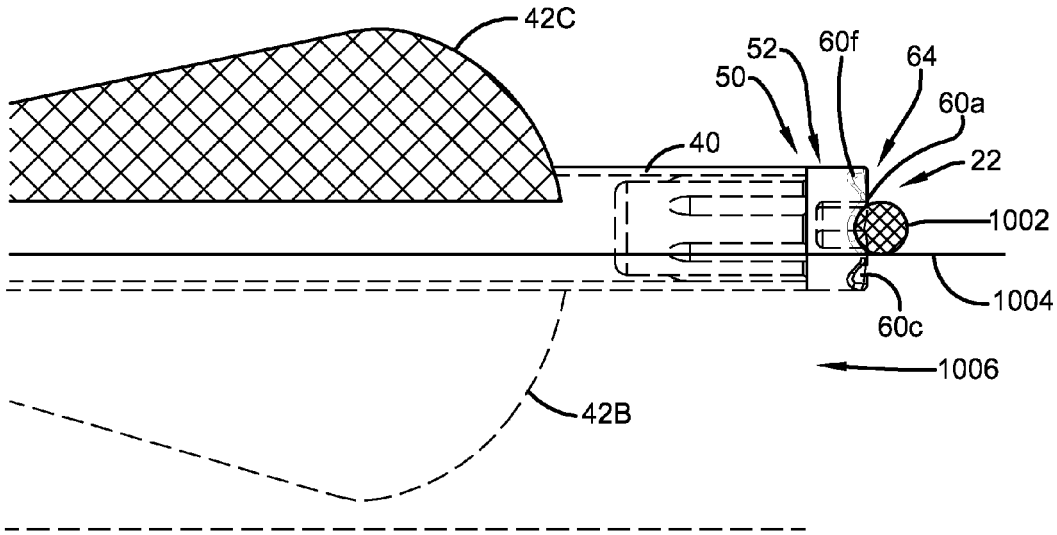
Figure 13A:
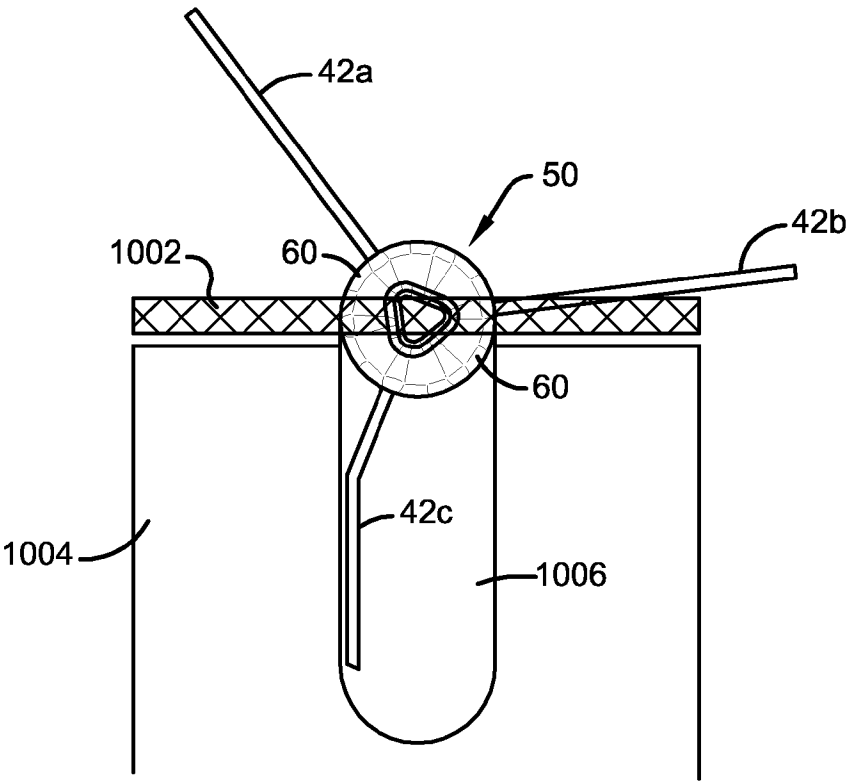
FIGS. 13A and 13B are component diagrams illustrating example implementations where one or more systems described herein may be implemented.
Figure 13B:
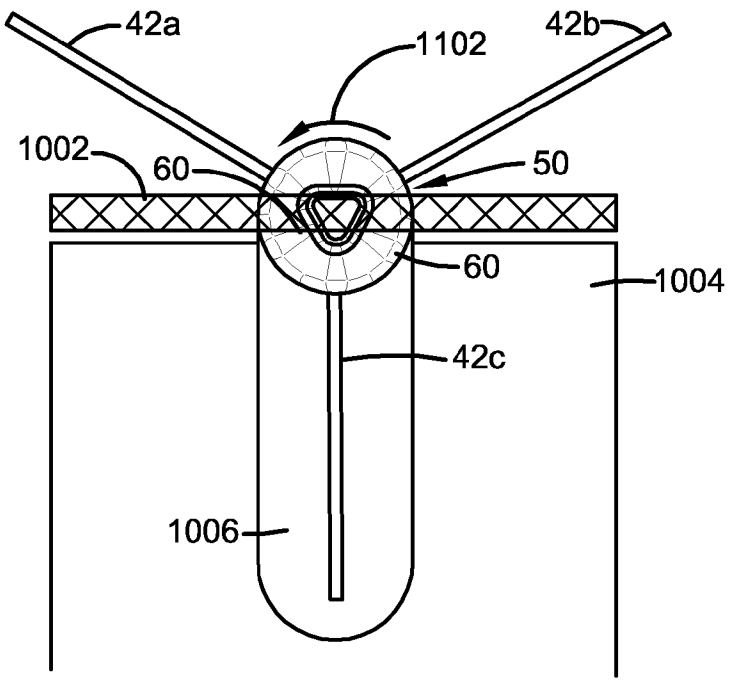

However, an arrow 40 shot with a misaligned nock may rise up 1104 from the barrel 1004, and/or rotate 1102 out of the barrel slot 1006 of a crossbow, causing an inaccurate shot. As one example, rotating a groove portion 22 of a half-moon nock out of alignment with the bowstring 1002, as illustrated in FIGS. 11A-C, can cause the arrow to rise 1104 and rotate 1102 out of the barrel slot 1006 when shot from the crossbow. In this example, raising 1104 and rotating 1102 the arrow 40 out of the barrel slot 1006 may cause the arrow 40 to miss the intended target, due to undesired alignment of the arrow's fletchings 42 during a flight path of the shot.

In one implementation, the user of the crossbow may misalign the groove portion 22 of the traditional nock with the bowstring 1002, for example, by inadvertently placing the incorrect fletching vane 42*c* in the barrel slot 1006. In this implementation, for example, when the bowstring 1002 is released (e.g., shot) the shape of the groove portion 22 of the half-moon nock may cause the arrow 40 to rotate 1102 (e.g., counter-clockwise in this example) as the groove portion 22 is forced to align with the bowstring 1002 during the shot (e.g., due to a great force applied by the bowstring to nock during a shot). Further, in this example, the rotation 1102 of the arrow 40 can force the fletching vane 42*c* against a wall of the barrel slot 1006, thereby pushing the arrow 40 up 1104 and out of the barrel slot 1006 during the shot. Additionally, the rotation 1102 can force the fletching vane 42*a* against the barrel 1004, further providing for the arrow 40 to rise 1104 out of the barrel slot 1006 (e.g., due to the configuration of the vanes 42).

In one implementation of this aspect, as illustrated in FIGS. 12A-B and 13A-B, when an arrow 40 comprising the alternate nock design 50 is misaligned on the bowstring 1002, the design of the alternate nock 50 can cause the arrow 40 to rotate into appropriate alignment upon release of the bowstring 1002. That is, for example, instead of causing the arrow to rise and rotate out of the barrel slot 1006 of a crossbow, the bowstring 1002 engaging with the alternate nock 50 can cause the arrow 40 to rotate 1102 into appropriate alignment (e.g., in the barrel slot 1006) prior to release from the bow, and not deviate from a desired path (e.g., rise up), thereby providing a more accurate shot.

In this implementation, the disposition of the string guide impressions 60 on the top surface 64 of the top portion 52 of the nock 50 may provide for multiple alignment positions for the arrow 40, with respect to the fletching vanes 40 and the bow. That is, for example, when using a crossbow, a first fletching vane 42*b* may be disposed in the barrel slot 1006, where respective second fletching vanes 42*a*, 42*b*, are disposed above, and not in contact with, the barrel. In this example, the first string impression 60*a* and the second string impression 60*b* may be engaged with the bowstring 1002 in a desired alignment (e.g., parallel). Further, if the arrow 40 is rotated such that the fletching vane 42*a* is disposed in the barrel slot 1006, string guide impression 60*e* and 60*f* may provide an appropriate alignment with the bowstring 1002. Additionally, if the arrow 40 is again rotated such that the fletching vane 42*c* is disposed in the barrel slot 1006, string guide impression 60*c* and 60*d* may provide an appropriate alignment with the bowstring 1002. That is, for example, regardless of which fletching vane 60 is disposed in the barrel slot 1006, an appropriate alignment of the bowstring 1002 to a string guide impression may be maintained.

In one implementation, in this aspect, use of the nock device 50 (e.g., described in FIGS. 5-9, 12, and 13) may mitigate undesired flight path characteristics for an arrow 40 that is misaligned with respect to the bowstring 1002. As one example, as in FIG. 13A, the nock device 50 may not be fully engaged with the bowstring, such that the bowstring 1002 is not in full contact with the respective string guide impressions (e.g., the nock is, at least, partially offset from the bowstring). In this example, the string guide impressions may not be aligned properly with the bowstring 1002 (e.g., the bowstring may not be aligned with the first bisecting line). In this implementation, for example, when the bowstring 1002 is released (e.g., the arrow is shot) the nock device 50 may cause the arrow 40 to rotate 1102 into proper alignment, prior to release from the bow, upon the bowstring 1002 engaging the nock device 50 (e.g., as in FIG. 13B).

As one example, the string guide impressions 60 may comprise a concave impression with gradually sloping sides (e.g., as illustrated in FIGS. 5B, 5C, 7A, 8B, 8C, and 9). In this implementation, for example, the concavity design of the impression 60 may allow the bowstring to slide down a gradually sloping side to the base of the impression 60, upon release of the bowstring 1002, when the bowstring 1002 is not appropriately aligned with the bisecting line 70 of the impression 60 (e.g., with the base of the impression 60). In this way, for example, an arrow 40 engaged with the alternate nock device 50 may rotate 1102 into proper alignment with the bowstring 1002, as the bowstring 1002 slides into the base of the impression 60 (e.g., the nock 50 slides up the bowstring 1002), upon release of the bowstring 1002.

A method may be devised wherein an alternate nock device may be used, for example, to nock an arrow for subsequent shooting (e.g., from a bow and/or crossbow). Typical nocks merely provide for a single alignment of a bowstring, for example, where the arrow may be oriented in an up or down position, according a nock's groove (e.g., bowstring receiver). Some flat nocks may allow for multiple alignments of the bowstring against the nock, but they may not provide for a centering (e.g., comprising a central bisection) of the bowstring on the flat portion of the nock. Using an alternate nock design (e.g., 50 in FIGS. 5-9), the user may be able to align the arrow on the bowstring in multiple alignments, and/or may be able to appropriately center the bowstring on the back (e.g., top surface) of the nock.

Figure 14:
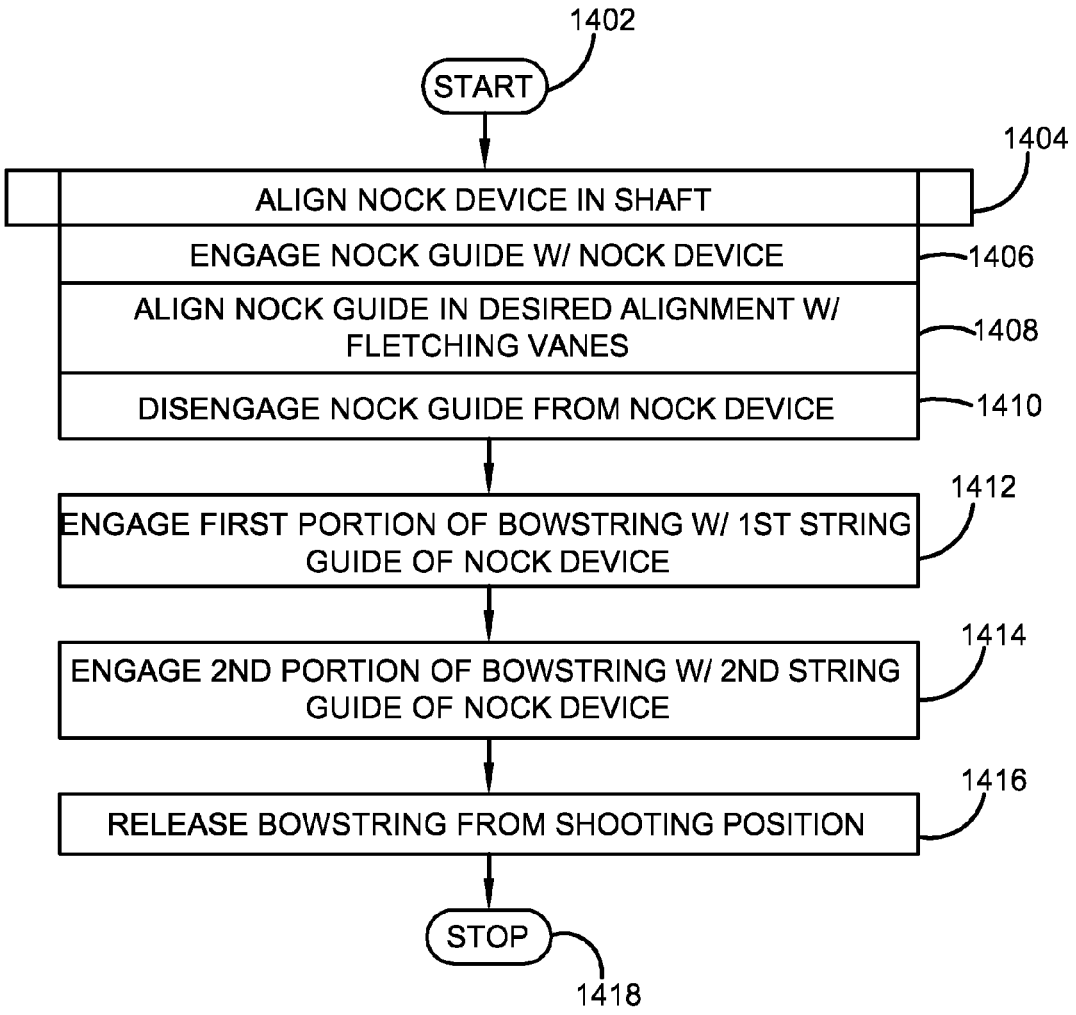
FIG. 14 is a flow diagram illustrating an implementation of an exemplary method for using a nock device.

FIG. 14 is a flow diagram illustrating an exemplary method 1000 for using a nock device. The exemplary method 1400 begins at 1402. At 1404 a process of aligning the nock device on/in a shaft of an arrow begins. That is, for example, when a nock is engaged with the shaft of the arrow, it is typically aligned in accordance with fletchings attached to the shaft. At 1406, a nock guide can be engaged with the nock device. As described above, the nock device may comprise an attachment slot on its top (e.g., back) surface of its top portion. In one implementation, the attachment slot can protrude, at least partially, into top portion of the nock device, for example, into which a user may selectively engage a male portion of the nock guide.

At 1408, the nock guide can be aligned in a desired alignment with the arrow's fletching vanes. As one example, the nock guide can be used to guide engagement of the nock device with the arrow shaft to a desired orientation, for example, with respect to one or more arrow fletching vanes disposed on said arrow shaft. As described above, the nock guide may comprise a groove, for example, that may engage a bowstring. In this example, the groove of the nock guide (e.g., 94 of FIG. 9) may be appropriately aligned with the bowstring, and the fletchings may be appropriately aligned (e.g., appropriate for a bow or crossbow) for shooting. In one embodiment, when aligned to the desired orientation, the nock device may be fully engaged (e.g., friction/pressure fit, and/or glued) in the desired orientation.

At 1410, the nock guide may be disengaged from the nock device. For example, the male portion of the nock guide may be pulled from the attachment slot on top of the top surface of the nock device. At 1412, a first portion of the bowstring can be engaged with a first string guide impression on the nock device; and a second portion of the bowstring can be engaged with a second string guide impression on the nock device, at 1414. In one implementation, a bowstring guide on the nock device may comprise a pair of impressions (e.g., the first and second), respectively disposed at opposite ends of a generally, centrally bisecting line across the top surface of the nock device. In this implementation, the user may engage (e.g., nock) the arrow to the bowstring by engaging the bowstring with both of the impressions in the pair, at two different locations (e.g., either end of the bisecting line). In this way, for example, the bowstring can be centrally aligned on the top surface of the nock, and, therefore, centrally aligned on the back of the arrow.

In one implementation, the nock device may comprise a third and a fourth string guide impression (e.g., a pair of impressions) that are respectively located at opposite ends of a second generally, centrally bisecting line of the top surface. In one implementation, the nock device may comprise a fifth and a sixth string guide impression that are respectively located at opposite ends of a third generally, centrally bisecting line of the top surface. In one implementation, the respective bisecting lines (e.g., and therefore the respective impressions) can be oriented on the top surface in a generally symmetrical layout, for example, such that an intersection of any two lines comprises a similar angle (e.g., ninety degrees, sixty degrees, forty-five degrees, thirty-six degrees, and/or thirty degrees), such as illustrated in FIGS. 6A-6D. In this way, for example, the user may engage (e.g., nock) the arrow to the bowstring using any one of the string guide impression pairs, based on the user's desired orientation of the arrow's fletchings.

At 1416 of the exemplary method 1400, the bowstring, engaged with the nock device, may be released from a shooting position. As one example, a bowstring of a bow (e.g., recurve, long, compound, etc.) may be released from a shooting position (e.g., where the bow is cocked, drawn, etc.) by the user when the user uncocks (e.g., straightens) their fingers wrapped around the bowstring, or may be released when the user opens or releases a bowstring release device engaged with the bowstring. As another example, a bowstring of a crossbow may be released when the user activate (e.g., pulls, releases, etc.) a trigger mechanism engaged with the bowstring. Typically, when the bowstring is released, the engagement of the nock to the bowstring causes the arrow to be shot from the bow (e.g., bow, crossbow).

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. An arrow nock comprising:

a top portion comprising a top surface, said top portion comprising a first string guide impression and a second string guide impression, wherein:

respective string guide impressions are symmetrically disposed on said top surface;

said first string guide impression is disposed at a first location on said top surface and is configured to receive a first part of a bowstring;

said second string guide impression is disposed at a second location of said top surface and is configured to receive a second part of said bowstring; and said first location and said second location are disposed at opposite ends of a first bisecting line of said top surface;

said top portion comprises a third string guide impression and a fourth string guide impression, wherein:

said third guide impression is disposed at a third location on said top surface and is configured to receive said first part of said bowstring;

said fourth string guide impression is disposed at a fourth location of said top surface and is configured to receive said second part of said bowstring; and said third location and said fourth location are disposed at opposite ends of a second bisecting line of said top surface.

2. The nock of claim 1, wherein said second bisecting line is disposed at one of:

a ninety degree angle with respect to the first bisecting line;

a sixty degree angle with respect to the first bisecting line;

a forty-five degree angle with respect to the first bisecting line;

a thirty-six degree angle with respect to the first bisecting line; and a thirty degree angle with respect to the first bisecting line.

3. The nock of claim 1, wherein said top portion comprises a fifth string guide impression and a sixth string guide impression, wherein:

said fifth guide impression is disposed at a fifth location on said top surface and is configured to receive said first part of said bowstring;

said sixth string guide impression is disposed at a sixth location of said top surface and is configured to receive said second part of said bowstring; and said fifth location and said sixth location are disposed at opposite ends of a third bisecting line of said top surface;

said third bisecting line is disposed at one of:

a sixty degree angle with respect to the first bisecting line;

a forty-five degree angle with respect to the first bisecting line;

a thirty-six degree angle with respect to the first bisecting line; and a thirty degree angle with respect to the first bisecting line.

4. The nock of claim 1, further comprising a stem portion configured to engage with an arrow shaft.

5. The nock of claim 1, wherein said nock guide is configured to guide a user of said nock to a desired orientation of said nock in an arrow shaft with regards to one or more arrow fletching vanes and a bowstring, and wherein said nock guide comprises one or more of:

a male portion, disposed at an engagement end of said nock guide, and configured to selectively engage with said attachment slot; and a nock guide slot, disposed at a bowstring engagement end of said nock guide, and configured to engage a bowstring.

6. A nock, comprising:

a first bowstring guide disposed along a first bisecting line of a top surface of said nock, wherein said first bowstring guide is configured to selectively receive a bowstring;

a second bowstring guide disposed along a second bisecting line of said top surface, wherein said second bowstring guide is configured to selectively receive said bowstring; and wherein at least one angle of intersection of said first bisecting line and said second bisecting line comprises sixty degrees.

7. The nock of claim 6, wherein said top surface comprises a third bowstring guide, wherein:

said third bowstring guide is disposed along a third bisecting line of said top surface and is configured to selectively receive said bowstring; and at least one angle of intersection of said first bisecting line and said third bisecting line comprises sixty degrees.

8. The nock of claim 6, wherein respective bowstring guides comprise a pair of string guide impressions, wherein respective members of said pair are disposed at opposite ends of a corresponding centrally bisecting line.

9. The nock of claim 6, further comprising an attachment slot disposed on said top surface and protruding at least partially into said nock, said attachment slot configured to selectively engage a nock guide; wherein said nock guide is configured to guide engagement of said nock with an arrow shaft to a desired orientation of said at least two bowstring guides with respect to one or more arrow fletching vanes disposed on said arrow shaft.

10. The device of claim 9, wherein said nock guide comprises one or more of:

a male portion, disposed at an engagement end of said nock guide, and configured to selectively engage with said attachment slot; and a nock guide slot, disposed at a bowstring engagement end of said nock guide, and configured to engage a bowstring.

11. The nock of claim 6, further comprising a stem portion configured to engage with an arrow shaft.

12. The nock of claim 11, wherein said stem portion comprises one or more outward protrusions configured to provide said stem portion with a pressure friction fit for engaging with said arrow shaft.

13. A device configured to align an arrow fletching vane with respect to a crossbow, comprising:

a self-aligning nock configured to cause an arrow shaft to:

(1) rotate a first fletching vane, engaged with said arrow shaft, into a first desired alignment upon release of a bowstring from a shooting position, wherein said bowstring is misaligned with said nock prior to release of said bowstring; and, rotate a second fletching vane, engaged with said arrow shaft, into a second desired alignment upon release of a bowstring from a shooting position, wherein said bowstring is misaligned with said nock prior to release of said bowstring.

14. The device of claim 13, wherein said desired alignment comprises said first fletching vane disposed in a barrel slot, of said crossbow, in vertical alignment with said barrel slot.

15. The device of claim 13, where said nock comprises at least three bowstring guides, wherein:

respective bowstring guides are configured to selectively engage said bowstring;

respective bowstring guides are disposed on a top surface of said nock at an angle of intersection of sixty degrees with at least one other bowstring guide; and respective bowstring guides intersect the other bowstring guides at a central point of said top surface.

16. The device of claim 15, wherein respective bowstring guides comprise a concave shape configured to guide said bowstring to a central concavity disposed along a central line of said bowstring guide.

* * * * *